US008424156B2

(12) United States Patent
Hsu

(10) Patent No.: US 8,424,156 B2
(45) Date of Patent: Apr. 23, 2013

(54) DOUBLE SUCTION TYPE STERILIZING VACUUM CLEANER

(75) Inventor: Pet-Cheng Hsu, Shinjuang (TW)

(73) Assignee: Yejen Appliances (Shenzhen) Limited, Shenzhen (CN)

( * ) Notice: Subject to any disclaimer, the term of this patent is extended or adjusted under 35 U.S.C. 154(b) by 335 days.

(21) Appl. No.: 12/958,445

(22) Filed: Dec. 2, 2010

(65) Prior Publication Data

US 2011/0138568 A1 Jun. 16, 2011

(30) Foreign Application Priority Data

Dec. 14, 2009 (CN) ..... 2009 2 0271935

(51) Int. Cl.
*A47L 5/00* (2006.01)

(52) U.S. Cl.
USPC ..... 15/382; 15/339; 15/347; 15/352; 15/375

(58) Field of Classification Search ..... 15/339, 15/347, 352, 375, 382, 421; *A47L 5/00*
See application file for complete search history.

(56) References Cited

U.S. PATENT DOCUMENTS 7,836,548 B2 * 11/2010 Cho ..... 15/421

* cited by examiner

*Primary Examiner* — David Redding
(74) *Attorney, Agent, or Firm* — Alan Kamrath; Kamrath IP Lawfirm, P.A.

(57) ABSTRACT

A double suction type sterilizing vacuum cleaner includes a base seat and an upper cover mounted on an upper side of the base seat. A main suction port is provided in the base seat. A hitting device is mounted on the base seat and adapted to hit a cleaning object under the base seat. A sterilizing lamp is mounted in the base seat for sterilizing purposes. A dust collecting box is detachably mounted to the upper cover and defines an air channel in communication with the main suction port. A secondary suction port is provided in the dust collecting box and in communication with the air channel. When the main suction port is blocked, an ambient air can be supplied to the air channel through the secondary suction port, facilitating the release of the blocking situation in the main suction port.

8 Claims, 10 Drawing Sheets

DOUBLE SUCTION TYPE STERILIZING VACUUM CLEANER

BACKGROUND OF THE INVENTION

1. Field of the Invention

The present invention relates to a vacuum cleaner and, more particularly, to a sterilizing vacuum cleaner with double suction ports.

2. Description of the Related Art

Vacuum cleaners are frequently used for cleaning and removing dust. The vacuum cleaners for bed clothes such as comforters are generally installed with hitting and sterilizing devices. The hitting device bobs bed clothes so that the dust on the bed clothes flies up and then is sucked in through a suction force generated by a motor. The sterilizing device emits ultraviolet rays to the dust so as to sterilize small pests in the dust.

FIG. 10 shows a conventional vacuum cleaner including a main body 90. The main body 90 is provided with a suction port 91, a first sterilizing portion 92, a second sterilizing portion 93, a motor 94, a third sterilizing portion 95, and a discharge port 96. When a bed clothes such as comforter is cleaned, an ambient air with dust is sucked in main body 90 through the suction port 91 under operation of the motor 94. Then, first and second sterilizing portions 92 and 93 emit ultraviolet rays to sterilize small pests in the dust, and third sterilizing portion 95 heats and kills the small pests before the air is exhausted through the discharge port 96.

However, since the cleaning objects to be sterilized are usually soft, the suction port 91 is apt to be blocked by attaching of the soft cleaning object due to the strong suction force of the motor 94. When suction port 91 is totally blocked, it is difficult for a user to quickly release the soft cleaning object from the suction port 91. In the blocking period, the circulation of an air flow in the vacuum cleaner is not smooth so that an overheating phenomenon may be caused in the motor 94, and the lifetime of the motor 94 is adversely affected.

BRIEF SUMMARY OF THE INVENTION

Therefore, it is an objective of the present invention to overcome the aforementioned shortcoming and deficiency of the prior art by providing a sterilizing vacuum cleaner with double suction ports. When a main suction port is blocked, there is still another suction port that allows an air flow to be introduced into the vacuum cleaner so as to reduce a sucking pressure at the main suction port. Thus, a user can more easily release the blocking situation at the main suction port while effectively reducing overheating phenomenon of a motor of the vacuum cleaner.

The vacuum cleaner of this invention includes a base seat having upper and lower sides spaced in a vertical direction. The base seat further includes an exhaust port and a main suction port formed in the lower side of the base seat. An upper cover is mounted on the upper side of the base seat and includes an assembly opening. A hitting device is mounted on the base seat and adapted to hit a cleaning object under the lower side of the base seat. A sterilizing lamp is mounted in the base seat for emitting ultraviolet rays toward the lower side of the base seat. The vacuum cleaner further includes a dust collecting box detachably installed in the assembly opening of the upper cover. An air channel is formed in the dust collecting box and in communication with the exhaust port. A valve port is defined between the air channel and the main suction port. A valve sheet covers the valve port to allow the valve port to be opened or closed. The dust collecting box includes a secondary suction port in communication with the air channel for introducing an ambient air into the air channel. When the main suction port is blocked, the ambient air can be supplied to the air channel through the secondary suction port, facilitating the release of the blocking situation at the main suction port.

In a preferred form, the dust collecting box includes a hollow body, a flow guiding cover, and a valve seat. The hollow body includes a first opening formed in an upper side thereof and a second opening formed in a rear side thereof and spaced from the first opening. The valve port is formed in a lower side of the hollow body, and the valve sheet is mounted in the hollow body and above the valve port. The flow guiding cover is fixed to the hollow body and covers the first opening of the hollow body. The secondary suction port is formed in the flow guiding cover, and the air channel is defined in the hollow body.

Preferably, the flow guiding cover further includes a grid piece having at least one flow opening. The grid piece extends downwards from an underside of the flow guiding cover and includes a lower end abutting an inner surface of the first opening. A mounting slot is formed in the grid piece of the flow guiding cover, and an adjustment piece is mounted in the mounting slot and movable to form a full shielding, a partial shielding, or a fully open status relative to the flow opening.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
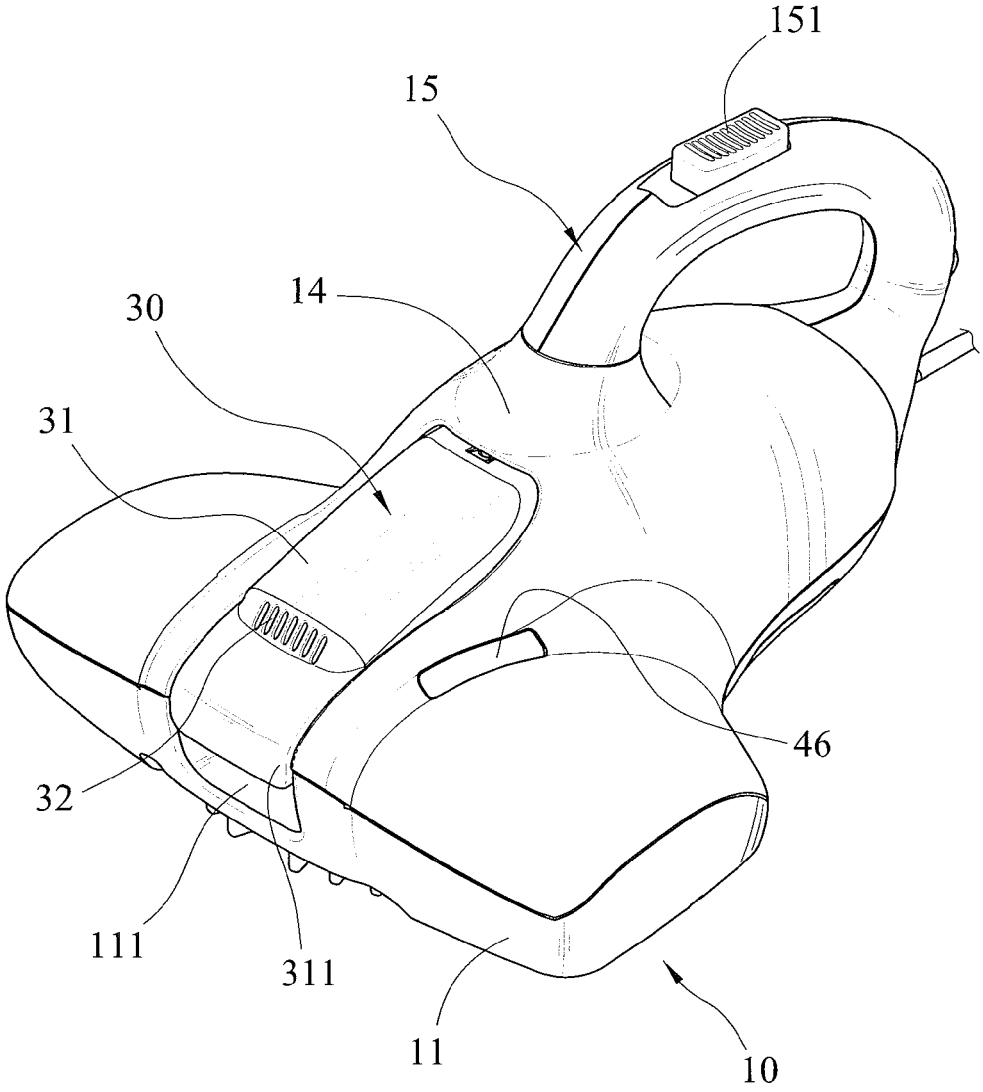
FIG. 1 shows a perspective view of a vacuum cleaner of a first embodiment according to the preferred teachings of the present invention.
Figure 2:
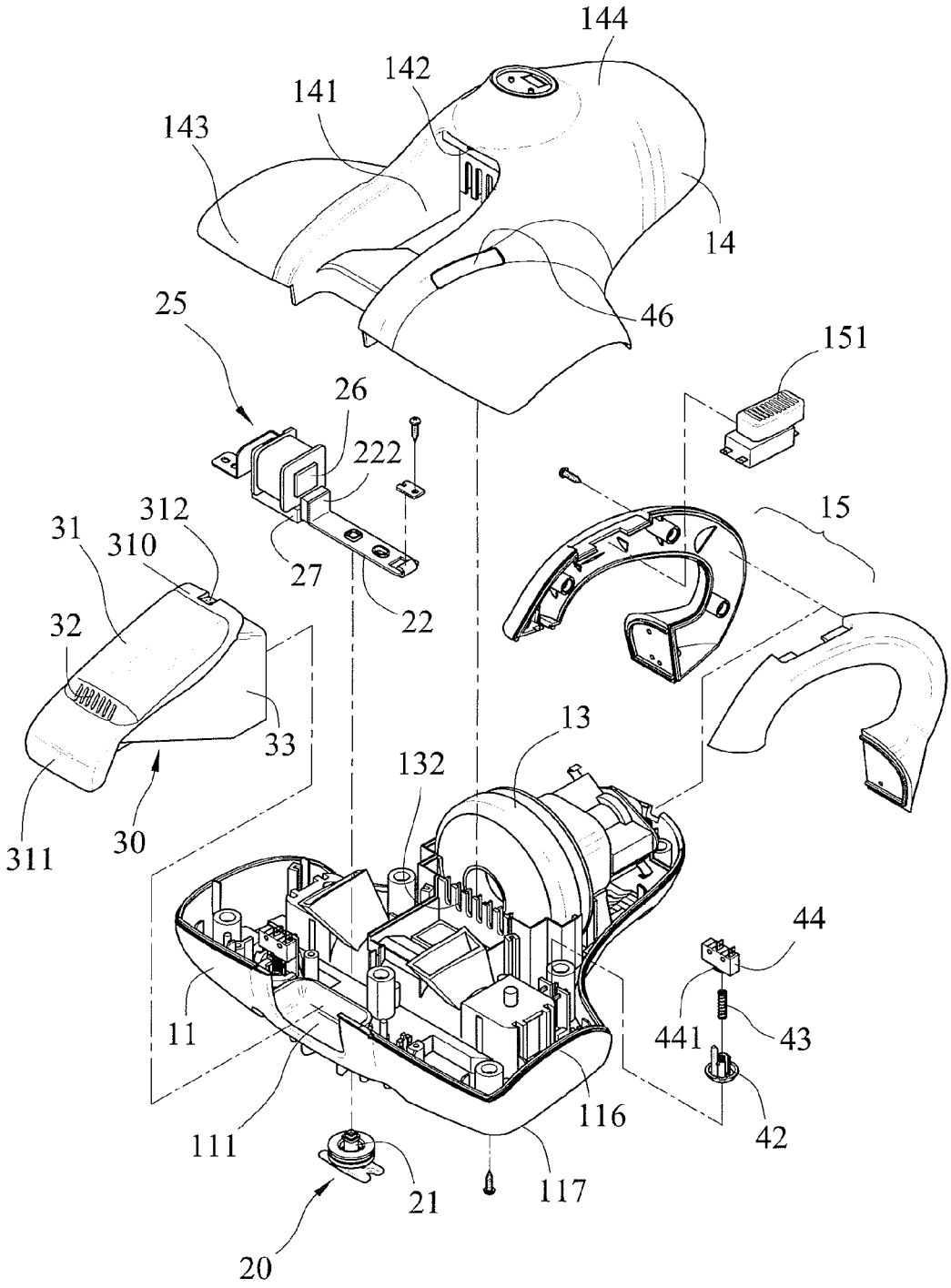
FIG. 2 is an exploded, perspective view of the vacuum cleaner of FIG. 1.
Figure 3:
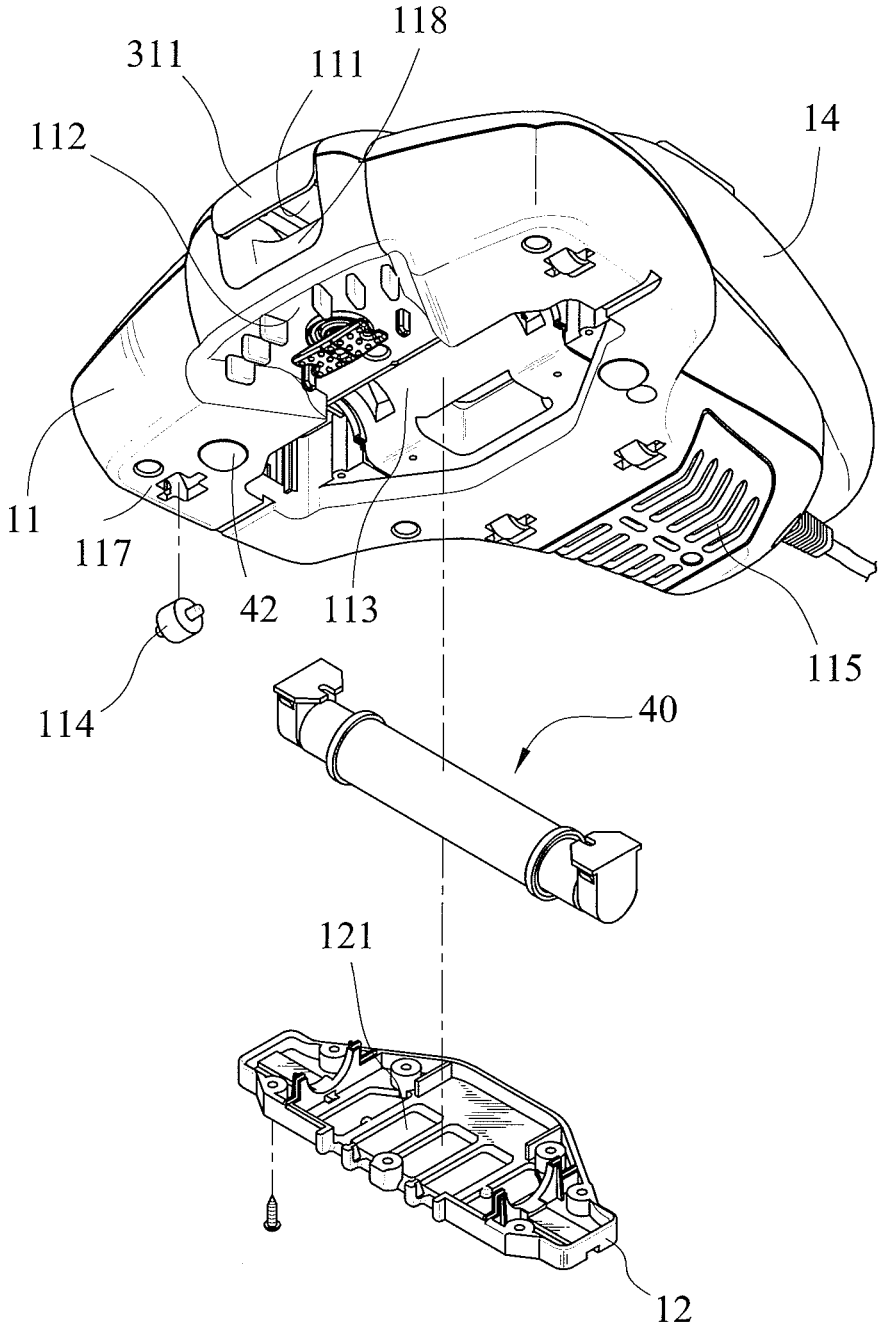
FIG. 3 is a partially exploded, perspective view of the vacuum cleaner of FIG. 1.
Figure 4:
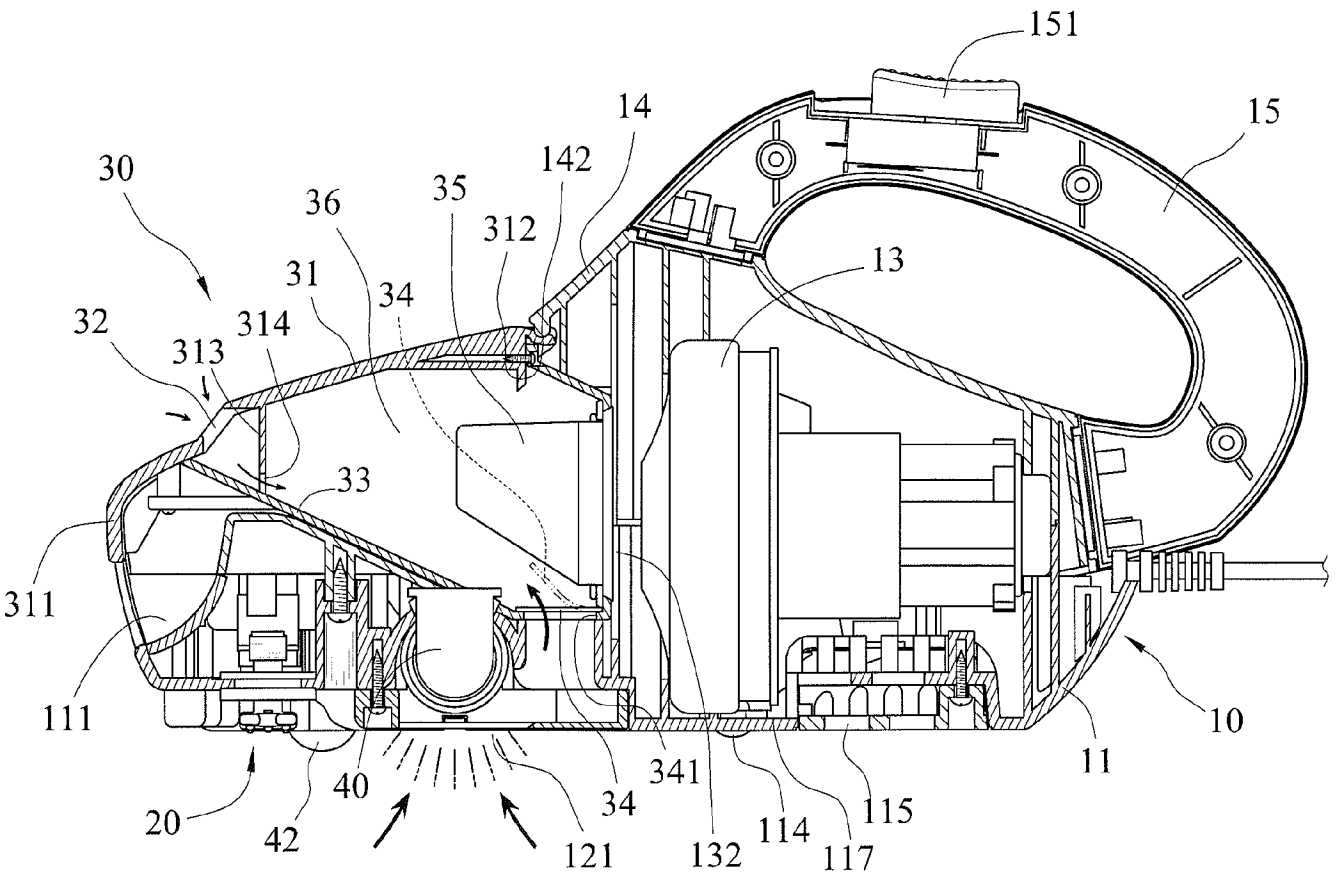
FIG. 4 is a cross sectional view of the vacuum cleaner of FIG. 1.
Figure 5:
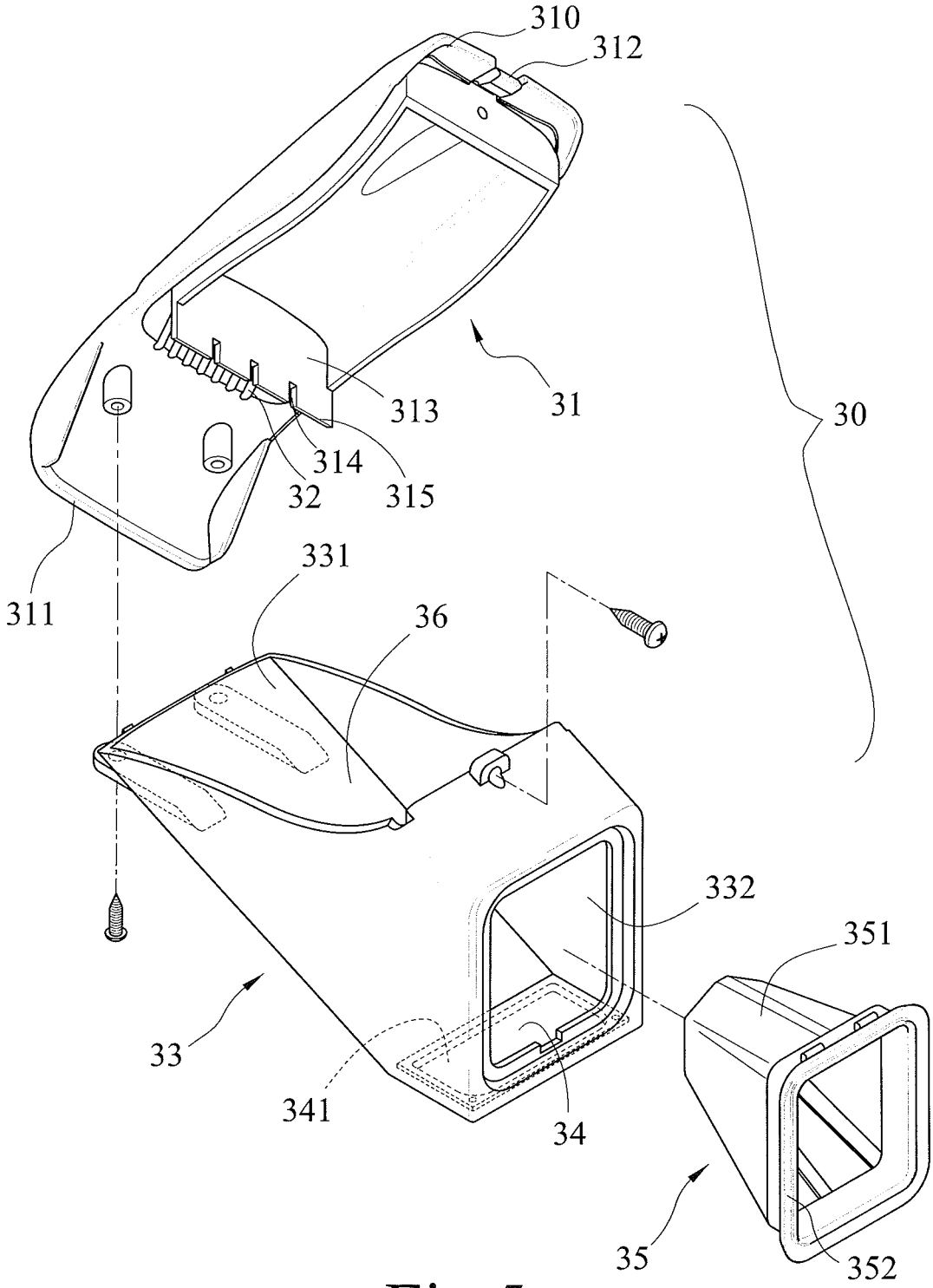
FIG. 5 is an exploded, perspective view of a dust collecting box of the vacuum cleaner of FIG. 2.
Figure 6:
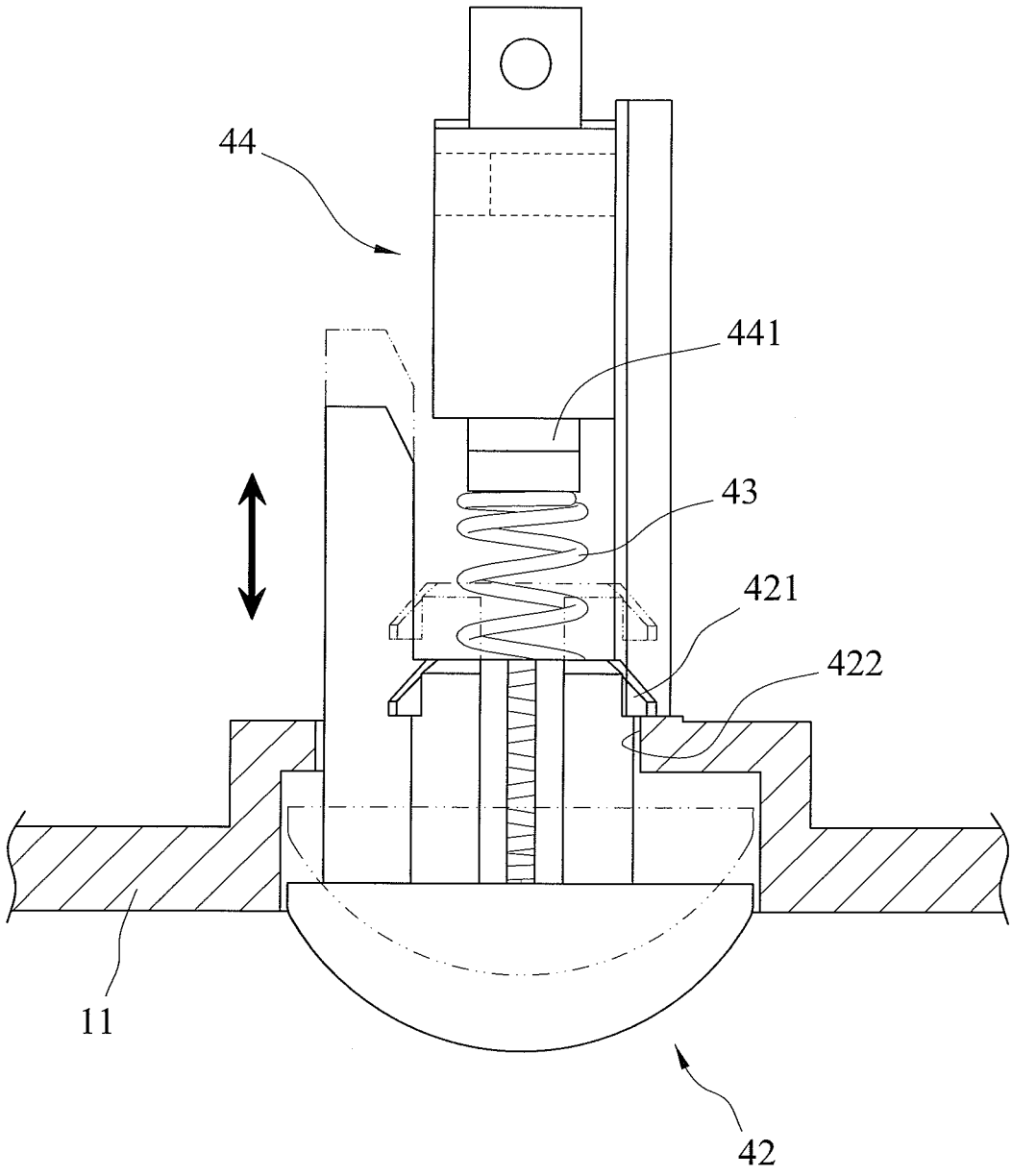
FIG. 6 is a partial, cross sectional view of the vacuum cleaner of FIG. 1 showing a sterilizing lamp protector of the vacuum cleaner.
Figure 7:
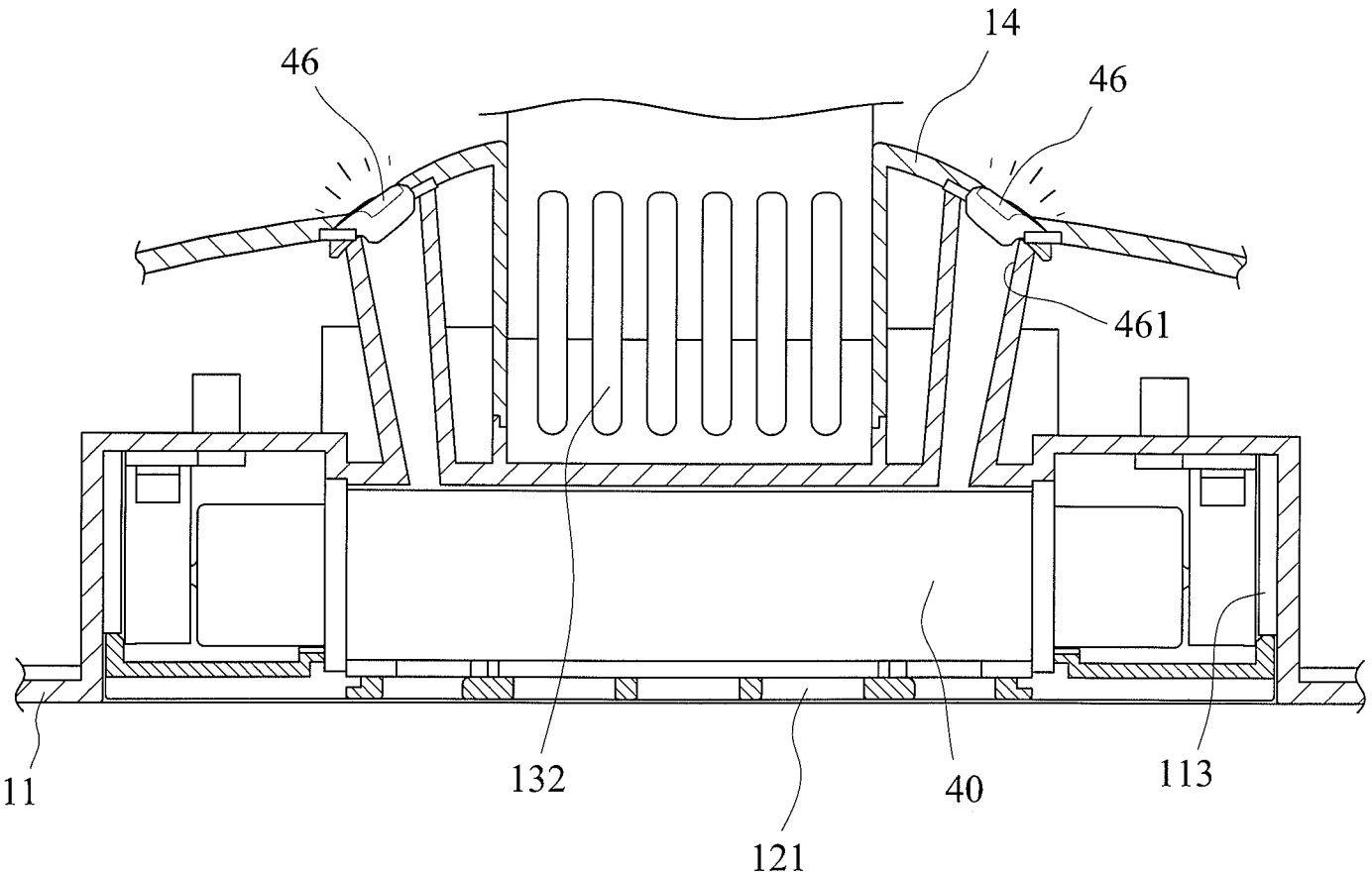
FIG. 7 is a partial, cross sectional view of the vacuum cleaner of FIG. 1 showing a sterilizing lamp and light emitting indicators of the vacuum cleaner.
Figure 8:
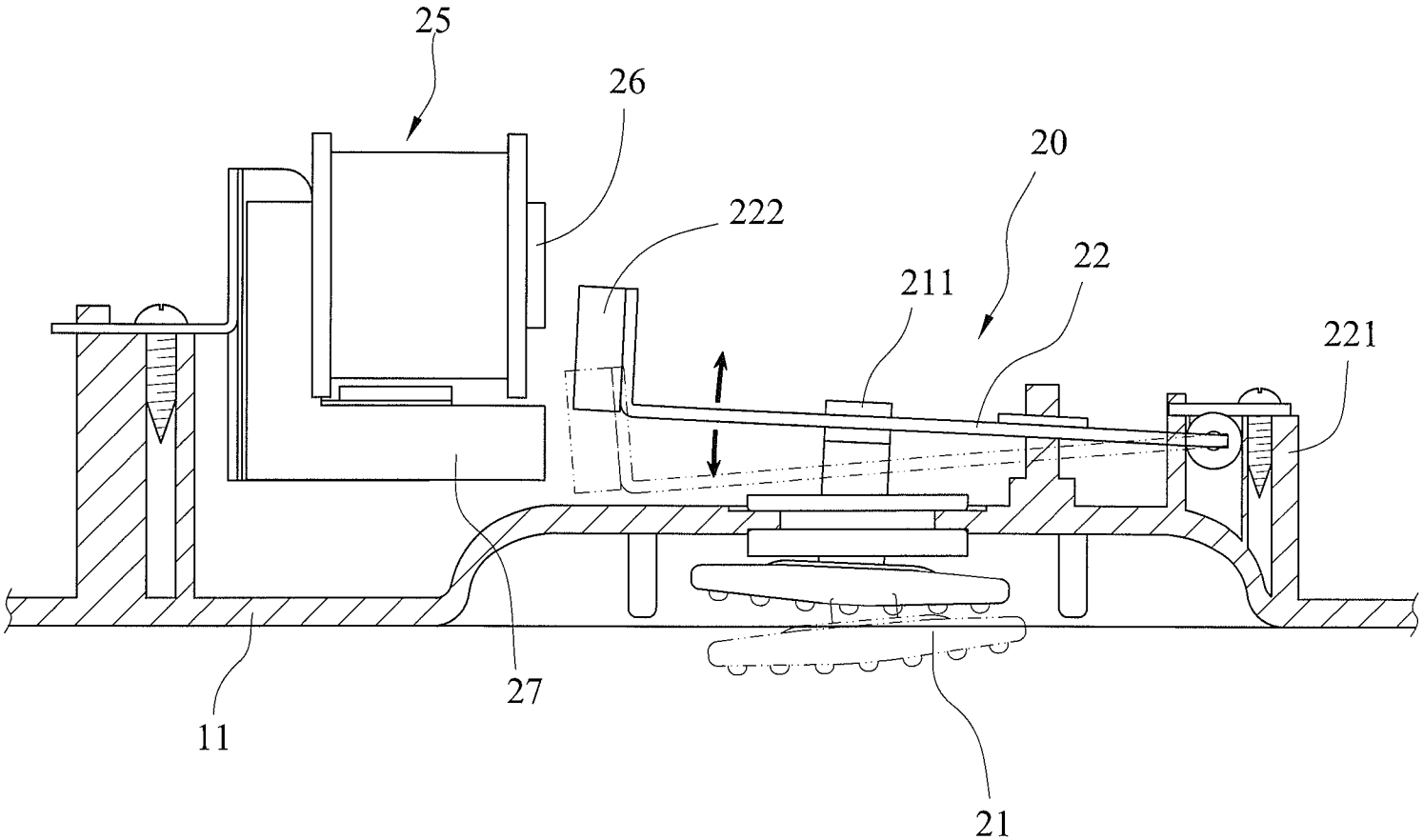
FIG. 8 is a partial, cross sectional view of the vacuum cleaner of FIG. 1 showing a hitting device of the vacuum cleaner.

A double suction type sterilizing vacuum cleaner of a first embodiment of the present invention is shown in FIGS. 1 through 8 of the drawings and generally designated 10. The vacuum cleaner 10 includes a base seat 11, an upper cover 14, a hitting device 20, a sterilizing lamp 40, and a dust collecting box 30.

The base seat 11 includes upper and lower sides 116 and 117 spaced in a vertical direction. Base seat 11 further includes a first recess 111 formed in a front side thereof, a second recess 112 formed in lower side 117, and a third recess 113 formed in lower side 117 and spaced from the second recess 112 (see FIG. 3). A bottom cover 12 covers third recess 113 and includes a plurality of holes forming a main suction port 121. A plurality of wheels 114 is installed on lower side 117 of base seat 11. A motor 13 is installed in a rear side of base seat 11 for generating a suction force. Several flow slots 132 are provided in upper side 116 of base seat 11 and located adjacent to a front end of motor 13. An exhaust port 115 is formed in lower side 117 of base seat 11 and located below motor 13.

Upper cover 14 is screwed and covers on upper side 116 of base seat 11. A tilted assembly opening 141 is formed in a front side 143 of upper cover 14, and a protruding lock portion 142 is formed on an inner top edge of assembly opening 141 (see FIG. 2). A handle 15 is mounted on a rear side 144 of upper cover 14 for gripping by a user and provided with a switch 151 that is electrically connected to motor 13 to control turning on/off of motor 13.

Hitting device 20 is mounted on base seat 11 and adapted to hit a cleaning object (not shown) under lower side 117 of base seat 11. In this embodiment, hitting device 20 is mounted in second recess 112 of base seat 11 with a bottom of hitting device 20 located at lower side 117 of base seat 11. Hitting device 20 includes a hitting member 21 having an inner end 211 extending into base seat 11 and engaged to an intermediate portion of an elongated swinging piece 22 mounted in base seat 11 (see FIG. 8). One end of swinging piece 22 is hinged to a standing post 221 formed in base seat 11, and the other end of swinging piece 22 is provided with a permanent magnet 222. Hitting device 20 further includes a driving portion 25 positioned at a location adjacent to magnet 222. Driving portion 25 includes two electromagnets, one being electromagnet N pole 26 and the other one being electromagnet S pole 27. Through the alternating of polarity of electromagnet N and S poles 26 and 27, magnet 222 and swinging piece 22 will swing up and down, which in turn leads to bob of hitting member 21.

Sterilizing lamp 40 is mounted in base seat 11 for emitting ultraviolet rays toward lower side 117 of base seat 11. In this embodiment, sterilizing lamp 40 is a UV lamp and installed in third recess 113 of base seat 11 and adjacent to main suction port 121. Sterilizing lamp 40 is electrically connected to switch 151 and two sterilizing lamp protectors 42. An inner end of each sterilizing lamp protector 42 is formed with a hook block 421 which extends into base seat 11 and coupled to an assembly hole 422 formed in base seat 11 with an outer end of each sterilizing lamp protector 42 located outside base seat 11 (see FIG. 6). Each sterilizing lamp protector 42 is movable in a limited space in base seat 11, and an inverted hook design of hook block 421 prevents each sterilizing lamp protector 42 from disengaging from base seat 11. A spring 43 includes a first end abutting against hook block 421 of one of sterilizing lamp protectors 42 and a second end abutting against a spring leaf 441 of a micro switch 44. Micro switch 44 is electrically connected to switch 151. When one of sterilizing lamp protectors 42 is pressed and moved inwards, spring 43 is compressed to press spring leaf 441 of micro switch 44, which in turn activates switch 151 and sterilizing lamp 40 so that sterilizing lamp 40 lights up. In this embodiment, sterilizing lamp protectors 42 are installed at two sides of lower side 117 of base seat 11 respectively so that sterilizing lamp 40 can be activated by pressing any one of sterilizing lamp protectors 42 to avoid the uneven issue in contacting the cleaning object. Furthermore, two light emitting indicators 46 are respectively fitted to two holes 461 of upper cover 14 formed in both sides of assembly opening 141 and corresponding to sterilizing lamps 40 (see FIG. 7). Light emitting indicators 46 sense the light emitting power of sterilizing lamps 40 and then generate light, indicating that sterilizing lamp 40 is in an activated and sterilizing state.

Dust collecting box 30 is installed in assembly opening 141 of upper cover 14 for collecting dust sucked into vacuum cleaner 10. Dust collecting box 30 includes a hollow body 33, a flow guiding cover 31, and a valve seat 35 (see FIG. 5). Hollow body 33 includes a first opening 331 formed in an upper side thereof and a second opening 332 formed in a rear side thereof and spaced from first opening 331. Hollow body 33 further includes a valve port 341 formed in a lower side thereof and in communication with the main suction port 121 of main body 10. A valve sheet 34 is mounted in hollow body 33 and above valve port 341. Flow guiding cover 31 is fixed to hollow body 33 and covers first opening 331 of hollow body 33. Flow guiding cover 31 includes a front end 311 and a rear end 310 with a locking slot 312. When dust collecting box 30 is installed in assembly opening 141 of upper cover 14, locking slot 312 and protruding lock 142 of upper cover 14 are coupled with each other so that dust collecting box 30 is positioned. Flow guiding cover 31 further includes a secondary suction port 32 intermediate front and rear ends 311 and 310 of flow guiding cover 31. A grid piece 313 with a plurality of flow openings 314 is extended downwards from an underside of flow guiding cover 31 and adjacent to secondary suction port 32. When flow guiding cover 31 covers on hollow body 33, a lower end 315 of grid piece 313 abuts an inner surface of first opening 331 (see FIG. 4). Moreover, a spacing 118 between first end 311 of flow guiding cover 31 and a front end of first recess 111 allows a hand of a user to be put in to control the installation of dust collecting box 30 or its detachment from base seat 11. Valve seat 35 includes a first end 351 with a first diameter and a second end 352 with a second diameter larger than the first diameter. The first end 351 of valve seat 35 is extended into hollow body 33, and second end 352 is coupled to second opening 332 of hollow body 33. An air channel 36 is defined in hollow body 33 and in communication with secondary suction port 32. Air channel 36 is in communication with main suction port 121 through valve port 341. Valve sheet 34 normally lies flat and closes valve port 341 to prevent the air flow in air channel 36 from flowing toward the main suction port 121. When an ambient air is flowed into main suction port 121, valve sheet 34 can be lifted up so that the air can be introduced into air channel 36 through valve port 341.

In operation, lower side 117 of base seat 11 contacts a cleaning object such as a bed clothes such that sterilizing lamp protectors 42 contact the cleaning object to activate switch 151 and micro switch 44. Thus, the dust, hair, and small pests adhering to the cleaning object are flown away from the cleaning object by a flapping action of the hitting device 20 and sterilized by ultraviolet rays generated from the sterilizing lamp 40. In the meanwhile, the ambient air containing the dust, hair, and small pests is introduced into main suction port 121, lifts up valve sheet 34 and then gets released through air channel 36, flow slots 132, and exhaust port 115 by the suction force generated from motor 13. In particular, through the provision of secondary suction port 32 in dust collecting box 30 of vacuum cleaner 10 of the present invention, an air inlet for the ambient air flow is provided when main suction port 121 gets blocked. That is, when main suction port 121 is blocked by attaching of the soft cleaning object due to the strong suction force of the motor 13, the introduced air flow from secondary suction port 32 can reduce the suction force at main suction port 121 so that the user can smoothly release and solve the blocking situation without using too much force, and the overheating phenomenon of motor 13 can be effectively reduced. Furthermore, the secondary suction port 32 may provide an air filtering function for the ambient air.

Figure 9:
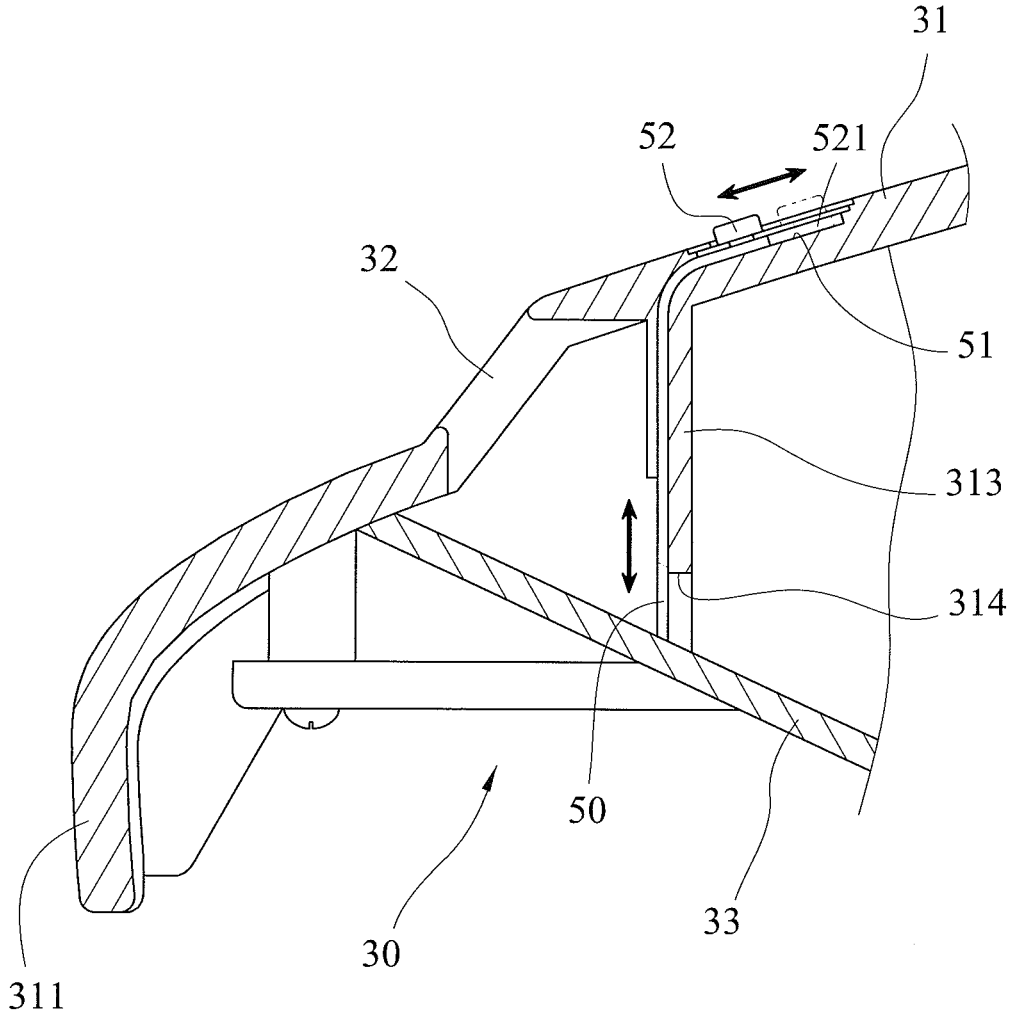
FIG. 9 shows a partial, cross sectional view of a vacuum cleaner of a second embodiment according to the preferred teachings of the present invention.
Figure 10:
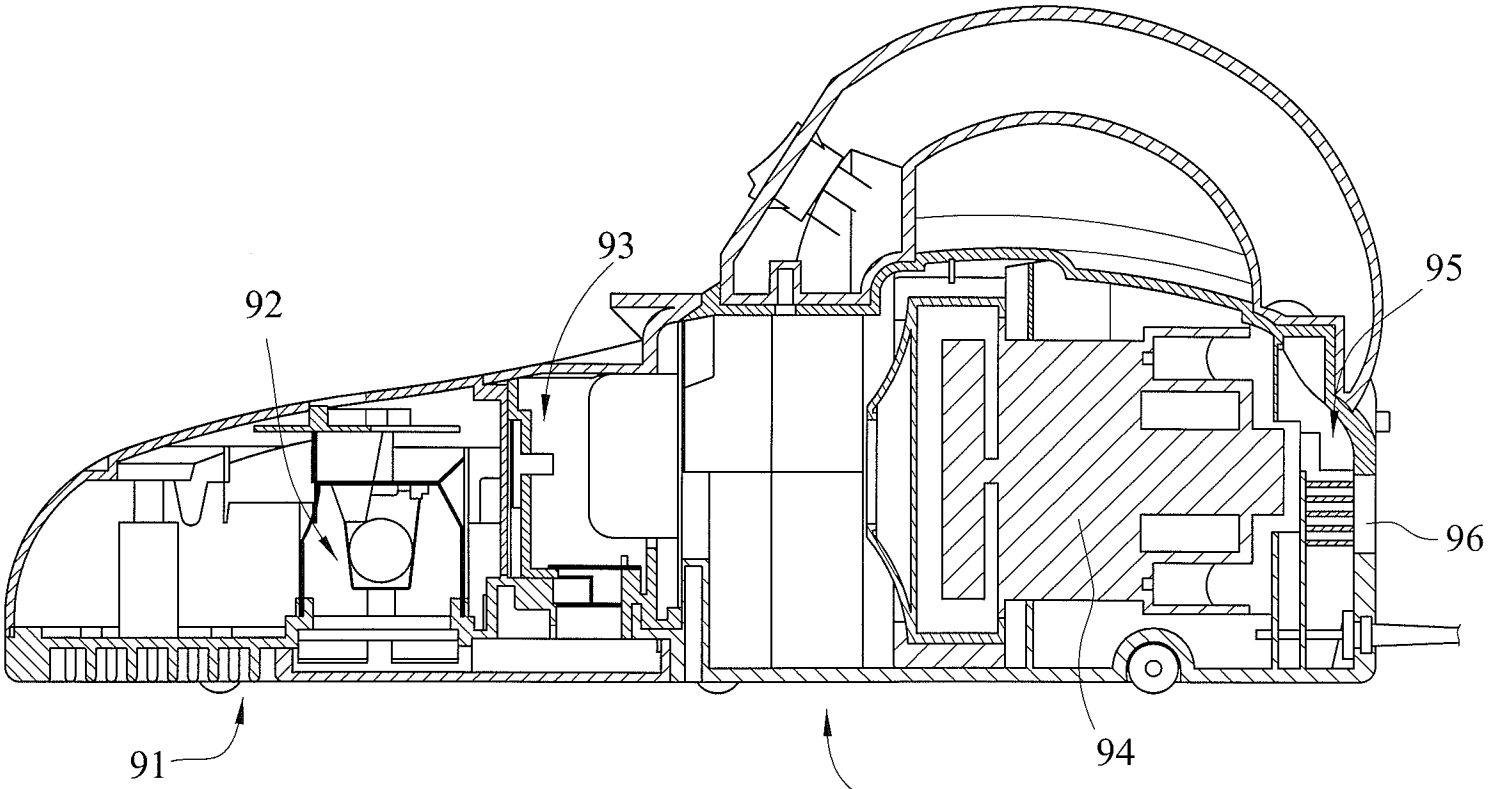
Fig 10 ( Prior Art )
FIG. 10 is a cross sectional view of a prior art vacuum cleaner.

Now that the basic teachings of the present invention have been explained, many extensions and variations will be obvious to one having ordinary skill in the art. The vacuum cleaner 10 shown in FIG. 9 is a modification of that shown in FIGS. 1 through 8. Description of the parts of vacuum cleaner 10 shown in FIG. 9 identical to those shown in FIGS. 1 through 8 is omitted. In particular, a mounting slot 51 is formed in grid piece 313 and extended to an upper side of flow guiding cover 31, and an adjustment piece 50 is mounted in mounting slot 51. A button 52 is provided on an upper end 521 of adjustment piece 50. When button 52 is pushed, adjustment piece 50 is moved to form a full shielding, a partial shielding, or a fully open status relative to flow openings 314 so that the air flow quantity entering air channel 36 through secondary suction port 32 can then be adjusted and controlled.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A double suction type sterilizing vacuum cleaner comprising:

a base seat including upper and lower sides spaced in a vertical direction, with the base seat further including an exhaust port and a main suction port formed in the lower side of the base seat;

an upper cover mounted on the upper side of the base seat and including an assembly opening;

a hitting device mounted on the lower side of the base seat and adapted to hit a cleaning object under the lower side of the base seat;

a sterilizing lamp mounted in the base seat for emitting rays toward the lower side of the base seat; and a dust collecting box detachably installed in the assembly opening of the upper cover, with an air channel formed in the dust collecting box and in communication with the exhaust port, with a valve port defined between the air channel and the main suction port, with a valve sheet covering the valve port to allow the valve port to be opened or closed, with a secondary suction port being provided in the dust collecting box and in communication with the air channel for introducing an ambient air into the air channel.

2. The vacuum cleaner according to claim 1, with the dust collecting box including a hollow body, a flow guiding cover, and a valve seat, with the hollow body including a first opening formed in an upper side thereof and a second opening formed in a rear side thereof and spaced from the first opening, with the valve port formed in a lower side of the hollow body, with the valve sheet mounted in the hollow body and above the valve port, with the flow guiding cover fixed to the hollow body and covering the first opening of the hollow body, with the secondary suction port formed in the flow guiding cover, and with the air channel defined in the hollow body.

3. The vacuum cleaner according to claim 2, with the flow guiding cover further including a grid piece having a flow opening, and with the grid piece extending downwards from an underside of the flow guiding cover and adjacent to the secondary suction port.

4. The vacuum cleaner according to claim 3, with a mounting slot formed in the grid piece of the flow guiding cover, and with an adjustment piece mounted in the mounting slot and being movable to form a full shielding, a partial shielding, or a fully open status relative to the flow opening.

5. The vacuum cleaner according to claim 4, with the valve seat including a first end with a first diameter and a second end with a second diameter larger than the first diameter, with the first end of the valve seat extending into the hollow body, and with the second end of the valve seat coupling to the second opening of the hollow body.

6. The vacuum cleaner according to claim 4, with the upper cover further including a protruding lock portion formed on an inner top edge of the assembly opening, and with the flow guiding cover including a locking slot coupled to the lock portion.

7. The vacuum cleaner according to claim 3, with the upper cover further including a protruding lock portion formed on an inner top edge of the assembly opening, and with the flow guiding cover including a locking slot coupled to the lock portion.

8. The vacuum cleaner according to claim 7, with the base seat further including a first recess formed in a front side thereof, a second recess formed in the lower side thereof, and a third recess formed in the lower side thereof and spaced from the second recess, with a bottom cover covering the third recess and including a plurality of holes forming the main suction port, with a spacing being between the flow guiding cover and a front end of the first recess of the base seat, with the hitting device mounted in the second recess of the base seat, and with the sterilizing lamp installed in the third recess of the base seat.

* * * * *